US010864758B2

(12) United States Patent
Miyazaki

(10) Patent No.: US 10,864,758 B2
(45) Date of Patent: Dec. 15, 2020

(54) RECORDING HEAD UNIT, IMAGE FORMING APPARATUS, AND LINE-HEAD MODULE

(71) Applicant: Takeshi Miyazaki, Kanagawa (JP)

(72) Inventor: Takeshi Miyazaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/517,753

(22) Filed: Jul. 22, 2019

(65) Prior Publication Data

US 2020/0031148 A1 Jan. 30, 2020

(30) Foreign Application Priority Data

Jul. 30, 2018 (JP) ..... 2018-142170
May 31, 2019 (JP) ..... 2019-102702

(51) Int. Cl.
*B41J 25/00* (2006.01)

(52) U.S. Cl.
CPC ..... *B41J 25/001* (2013.01); *B41J 25/003* (2013.01); *B41J 2202/21* (2013.01)

(58) Field of Classification Search
CPC ..... B41J 25/001; B41J 2202/21; B41J 25/003
See application file for complete search history.

(56) References Cited

U.S. PATENT DOCUMENTS 9,802,409 B2 * 10/2017 Yamabe ..... B41J 25/34
2014/0035218 A1 * 2/2014 Koyama ..... B65H 33/08 271/3.14

FOREIGN PATENT DOCUMENTS

JP 2001-113679 4/2001
JP 2013-252724 12/2013
JP 2014-014972 1/2014

OTHER PUBLICATIONS

U.S. Appl. No. 16/200,894, filed Nov. 27, 2018, Takeshi Miyazaki.

* cited by examiner

*Primary Examiner* — Geoffrey S Mruk
(74) *Attorney, Agent, or Firm* — Harness, Dickey & Pierce, P.L.C.

(57) ABSTRACT

A recording head unit includes a line-head module including a plurality of recording heads to discharge a liquid, and a main plate to which the line-head module is mounted. The line-head module includes a first adjustment portion to adjust a position of the line-head module relative to the main plate in a longitudinal direction of the line-head module, and a second adjustment portion to adjust a position of the line-head module relative to the main plate in a rotational direction of the line-head module.

11 Claims, 15 Drawing Sheets

RECORDING HEAD UNIT, IMAGE FORMING APPARATUS, AND LINE-HEAD MODULE

CROSS-REFERENCE TO RELATED APPLICATIONS

This patent application is based on and claims priority pursuant to 35 U.S.C. § 119(a) to Japanese Patent Application No. 2018-142170, filed on Jul. 30, 2018, and Japanese Patent Application No. 2019-102702, filed on May 31, 2019, in the Japan Patent Office, the entire disclosure of each of which are hereby incorporated by reference herein.

BACKGROUND

Technical Field

The present disclosure relates to a recording head unit, an image forming apparatus, and a line-head module.

Related Art

Several systems are used in an inkjet head as a recording head to generate pressure changes in the chambers of the inkjet head. Examples of the systems include a thermal inkjet system, a piezoelectric element system, and an electrostatic system. The thermal inkjet system includes a heater provided separately in each of the individual chambers to vaporize the liquid and thus change the pressure in the individual chambers. The piezoelectric element system includes a piezoelectric actuator provided in each of the individual chambers.

An inkjet recording apparatus as an example of an image forming apparatus includes the inkjet head to form a desired image on a recording medium. The inkjet recording apparatus supplies ink to the individual chambers of the inkjet head. The inkjet head applies a predetermined pressure to the ink in the individual chambers to discharge the liquid in the individual chambers from the nozzle so that the ink is discharged from the nozzle and recorded on the recording medium.

Either a serial-head system or a line-head system may be used in the inkjet recording apparatus. The serial-head system includes a recording head that is narrower than a width of a recording medium. The recording head moves reciprocally at high speed in a width direction of the recording medium while the recording medium is conveyed line by line in a direction perpendicular to the width direction of the recording medium to record images across the entire recording medium. A line-head system includes a long recording head having a length equal to or greater than a width of a recording medium. The line-head system can form an image on a wide area of the recording medium at one time.

The line-head system is suitable for high-speed image formation, and a long recording head is needed for line-head system. However, it is expensive to manufacture the long recording head with a single recording head. Thus, the line-head system includes a recording head unit that in turn includes a plurality of small head modules arrayed on a base plate of the inkjet recording apparatus.

Further, it is preferred to output an image forming product having high image quality of 1200 dpi or more. To achieve high-speed and high-quality image formation, the head modules have to be highly accurately positioned and arrayed in parallel on the base plate of the apparatus body of the inkjet recording apparatus, that is, with an accuracy of involving a margin of error of no more than several μm. However, it is difficult to accurately process the head module to have such positional, because the plurality of head modules have to be adjusted individually to obtain the desired highly accurately positioning.

At the same time, if a positioning mechanism to position the head modules is provided on the apparatus body of the inkjet recording apparatus, the apparatus body increases in size. Further, it takes time and effort to adjust the position of the head modules depending on a configuration of the positioning mechanism.

SUMMARY

In an aspect of this disclosure, a novel recording head unit includes a line-head module including a plurality of recording heads to discharge a liquid, and a main plate to which the line-head module is mounted. The line-head module includes a first adjustment portion to adjust a position of the line-head module relative to the main plate in a longitudinal direction of the line-head module, and a second adjustment portion to adjust a position of the line-head module relative to the main plate in a rotational direction of the line-head module.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
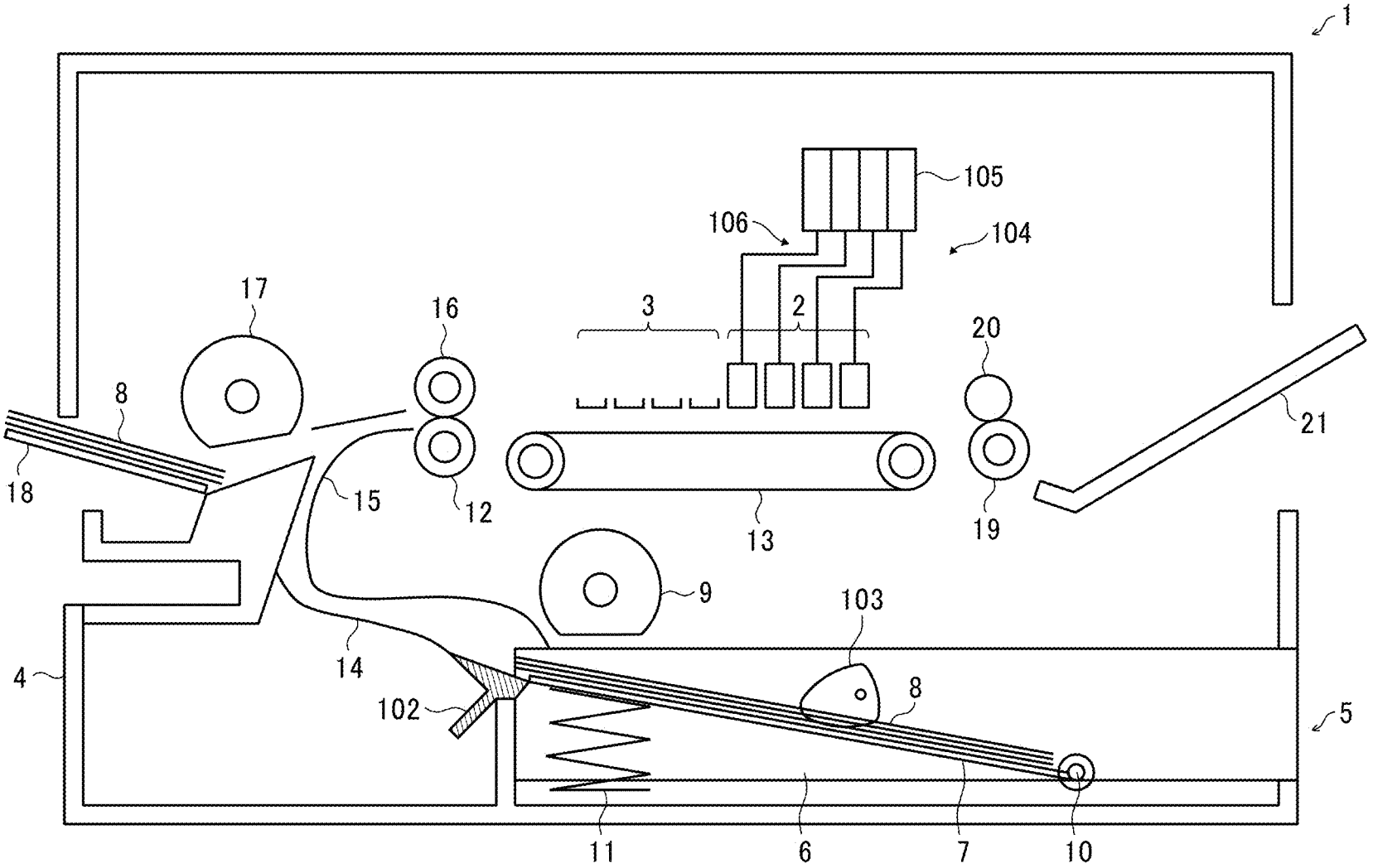
FIG. 1 is a schematic cross-sectional view of an inkjet recording apparatus to which an embodiment of the present disclosure is applicable.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

FIG. 1 is a schematic cross-sectional view of an inkjet recording apparatus 1 that is a color printer as an image forming apparatus to which an embodiment of the present disclosure is applicable. The inkjet recording apparatus 1 is a line-type printer equipped with a line-type liquid discharge head (line head) including a nozzle array having a length equal to or larger than a printing width of a recording medium.

As illustrated in FIG. 1, the inkjet recording apparatus 1 includes a plurality of recording head units 2, including recording heads 2A to 2D (see FIG. 2) that are four line-type liquid discharge heads for the four colors of black, magenta, cyan, and yellow, respectively. The inkjet recording apparatus 1 includes a maintenance unit 3 arranged in a vicinity of the recording head unit 2. The maintenance unit 3 corresponds to recording heads of the recording head unit 2. The recording head unit 2 moves to a position facing the maintenance unit 3 for cleaning. The maintenance unit 3 performs such maintenance operations as a purging process and a wiping process.

The inkjet recording apparatus 1 includes a sheet-feeding tray 5 at a lower part of an apparatus body 4. The sheet-feeding tray 5 includes a pressure plate 7, a sheet-feeding roller 9 to feed a recording sheet 8 as a recording medium, and a base 6. The pressure plate 7 and the sheet-feeding roller 9 are attached to the base 6. The pressure plate 7 is rotatable around a rotating shaft 10 attached to the base 6 and is biased toward the sheet-feeding roller 9 by a pressure of the leaf spring 11. The sheet-feeding tray 5 includes a separation pad 102 made of a high friction resistance member such as artificial leather to prevent double feeding of the recording sheet 8 at a portion of the pressure plate 7 facing the sheet-feeding roller 9. The sheet-feeding tray 5 further includes a release cam 103 to contact and separate the pressure plate 7 and the sheet-feeding roller 9 near the sheet-feeding roller 9.

In the above-described configuration, the release cam 103 pushes the pressure plate 7 down to a predetermined position when the inkjet recording apparatus 1 is in a standby state. Thus, the release cam 103 releases a contact between the pressure plate 7 and the sheet-feeding roller 9. When the pressure plate 7 separates from the sheet-feeding roller 9, a driving force of a conveyance roller 12 disposed downstream of the sheet-feeding roller 9 in a sheet conveyance direction is transmitted to the sheet-feeding roller 9 and the release cam 103 via a gear. The sheet conveyance direction (Y-direction) is indicated by arrow "Y" in FIG. 1. When the release cam 103 separates from the pressure plate 7 and the pressure plate 7 rises, the sheet-feeding roller 9 contacts the recording sheet 8. As the sheet-feeding roller 9 rotates, the recording sheet 8 is picked up and sheet-feeding is started. The recording sheet 8 is separated one by one by the separation pad 102.

The sheet-feeding roller 9 rotates to feed the recording sheet 8 to the sheet conveyor 13 positioned below the recording heads 2A to 2D of the recording head unit 2. The recording sheet 8 passes between the guide plates 14 and 15 and is guided to the conveyance roller 12. The recording sheet 8 is conveyed to the sheet conveyor 13 by the conveyance roller 12 and the pinch roller 16 paired with the conveyance roller 12.

Then, the inkjet recording apparatus 1 is again returned to the standby state in which the recording sheet 8 separates from the sheet-feeding roller 9, and the driving force transmitted from the conveyance roller 12 to the recording sheet 8 is cut off. In FIG. 1, the inkjet recording apparatus 1 includes a second sheet-feeding roller 17 to manually feed the recording sheet 8. The recording sheet 8 placed on the manual feed tray 18 is fed according to a recording signal from the controller and is conveyed between the conveyance roller 12 and the pinch roller 16.

The recording sheet 8 conveyed to the sheet conveyor 13 passes below the recording head unit 2. The inkjet recording apparatus 1 includes a controller to control the recording head unit 2 and the sheet conveyor 13, for example. The controller controls a timing of liquid discharge from the recording head unit 2 and a conveyance speed of the recording sheet 8 by the sheet conveyor 13. Thus, a desired image is recorded on the recording sheet 8 by the recording head unit 2 and the sheet conveyor 13.

The recording sheet 8 on which an image is recorded is nipped and conveyed by an ejection roller 19 and a spur 20 and ejected onto the sheet discharge tray 21. The inkjet recording apparatus 1 further includes an ink supply unit 104 above the recording head unit 2. The ink supply unit 104 includes ink tanks 105 to accommodate respective colors of ink to be supplied to the recording head unit 2 and a supply system 106 connecting the ink tanks 105 and the recording head unit 2 to supply respective inks in the ink tanks 105 to the corresponding recording head unit 2.

Figure 2:
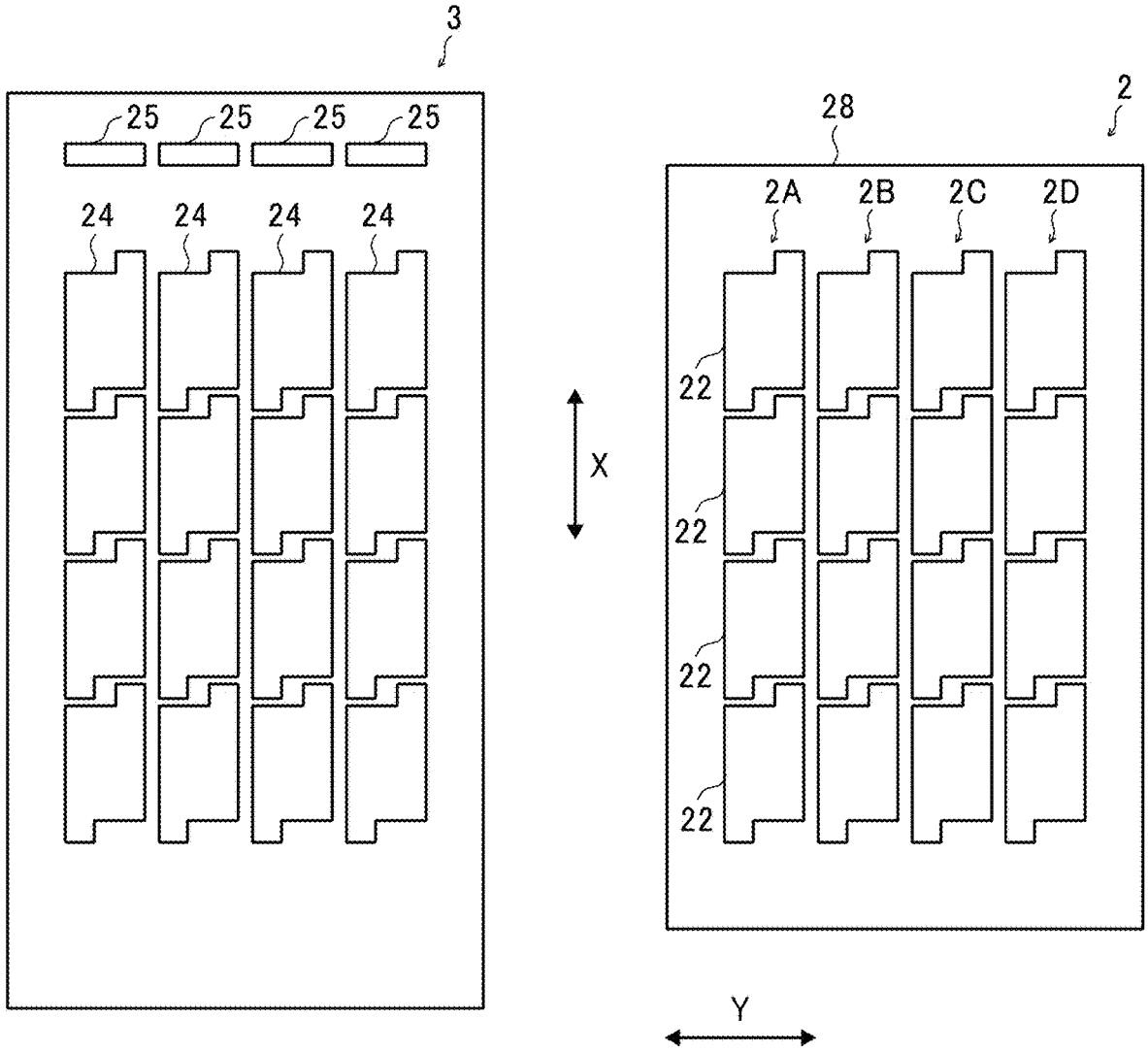
FIG. 2 is a schematic plan view of a recording head unit and a maintenance unit in the embodiment of the present disclosure.

FIG. 2 is a plan view of the recording head unit 2 and the maintenance unit 3. In FIG. 2, a supply unit is removed from the recording head unit 2 and the maintenance unit 3. The recording head unit 2 includes four types of recording head groups corresponding to four colors: a black recording head 2A, a yellow recording head 2B, a magenta recording head 2C, and a cyan recording head 2D. Configurations of the recording heads 2A, 2B, 2C, and 2D are identical except that the colors of the inks used in each of the recording heads 2A to 2D are different. Here, a configuration of the black recording head 2A is described below as an example.

The recording head 2A includes a plurality of (four in the present embodiment) line-head modules 22 having a plurality of recording heads arranged in parallel in a width direction of the recording sheet 8 as a recording medium. The width direction (X-direction) of the recording sheet 8 is indicated by arrow "X" in FIG. 2, that is, orthogonal to the sheet conveyance direction "Y" (Y-direction). Each line-head module 22 is fixed to a main plate 28 fixed to the apparatus body 4.

A maintenance unit 3 (illustrated in FIG. 1) is disposed adjacent to the recording head unit 2. The maintenance unit 3 is attachably detachable to each of the line-head modules 22 of the recording head unit 2. The maintenance unit 3 includes a plurality of caps 24 and a plurality of wipers 25, for example. The plurality of caps 24 suctions ink from and retains moisture of the line-head modules 22. The plurality of wipers 25 wipes and removes excess ink from a discharge surface of each of line-head modules 22.

The maintenance unit 3 is fixed to the apparatus body 4. The recording head unit 2 and the ink supply unit 104 move together in a horizontal direction and vertical direction as a single unit. Thus, each of the line-head modules 22 moves toward and away from the caps 24 and the wipers 25 and performs maintenance operation. The maintenance operation is mainly performed when no image forming operation is being performed, that is, when recording of an image onto the recording sheet 8 by the recording head unit 2 is not being performed.

Figure 3:
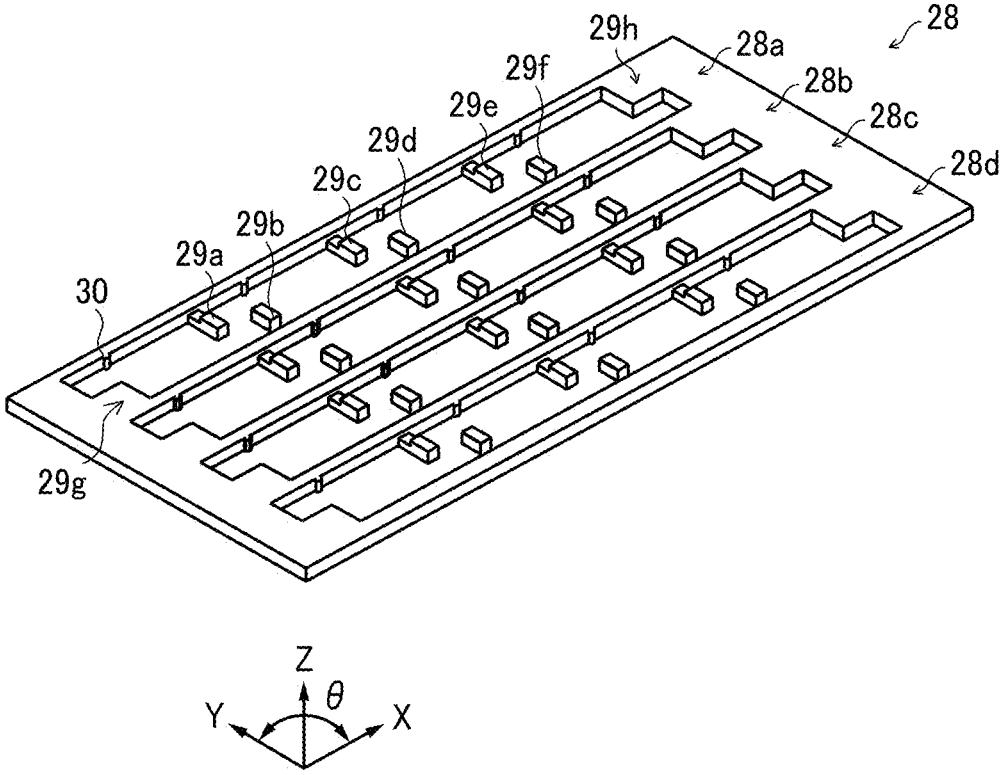
FIG. 3 is a schematic perspective view of a main plate in the embodiment of the present disclosure.

FIG. 3 is a perspective view of a main plate 28 made of stainless steel. The recording head unit 2 includes the main plate 28 in the apparatus body 4 to fix each of the line-head modules 22 in place. The recording head unit 2 according to the present disclosure includes four types of recording heads 2A, 2B, 2C, and 2D and the main plate 28 including four lines of arrangement portions 28*a*, 28*b*, 28*c*, and 28*d* since the line-head modules 22 are also arranged in four lines in Y-direction in FIG. 3. Only the arrangement portion 28*a* is explained below because each arrangement portions 28*a*, 28*b*, 28*c*, and 28*d* has an identical configuration.

Figure 4:
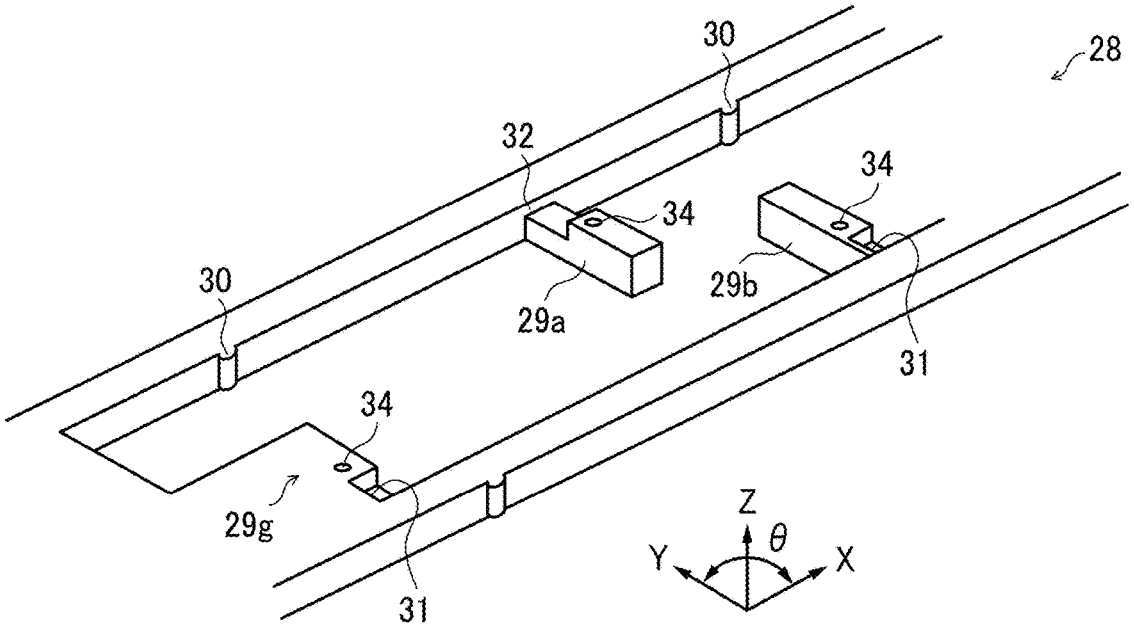
FIG. 4 is a schematic perspective view of a fixing portion of the main plate in the embodiment of the present disclosure.

The arrangement portion 28*a* includes six fixing portions 29*a*, 29*b*, 29*c*, 29*d*, 29*e*, and 29*f* arranged along X-direction. The arrangement portion 28*a* further includes fixing portions 29*g* and 29*h* arranged at both ends in a longitudinal direction of the recording head 2A (X-direction) that is along a longitudinal direction of the arrangement portion 28*a*. In FIG. 4, only the fixing portion 29*g* is illustrated and the fixing portion 29*h* is illustrated in FIG. 3.

Four line-head modules 22 are mounted to the arrangement portion 28*a* so that four line-head modules 22 are arranged in the X-direction in the arrangement portion 28*a* as illustrated in FIG. 2. First line-head module 22 is fixed to the main plate 28 at the fixing portions 29*g* and 29*a*. Second line-head module 22 is fixed to the main plate 28 at the fixing portions 29*b* and 29*c*. Third line-head module 22 is fixed to the main plate 28 at the fixing portions 29*d* and 29*e*, Fourth line-head module 22 is fixed to the main plate 28 at the fixing portions 29*f* and 29*h*.

Figure 5:
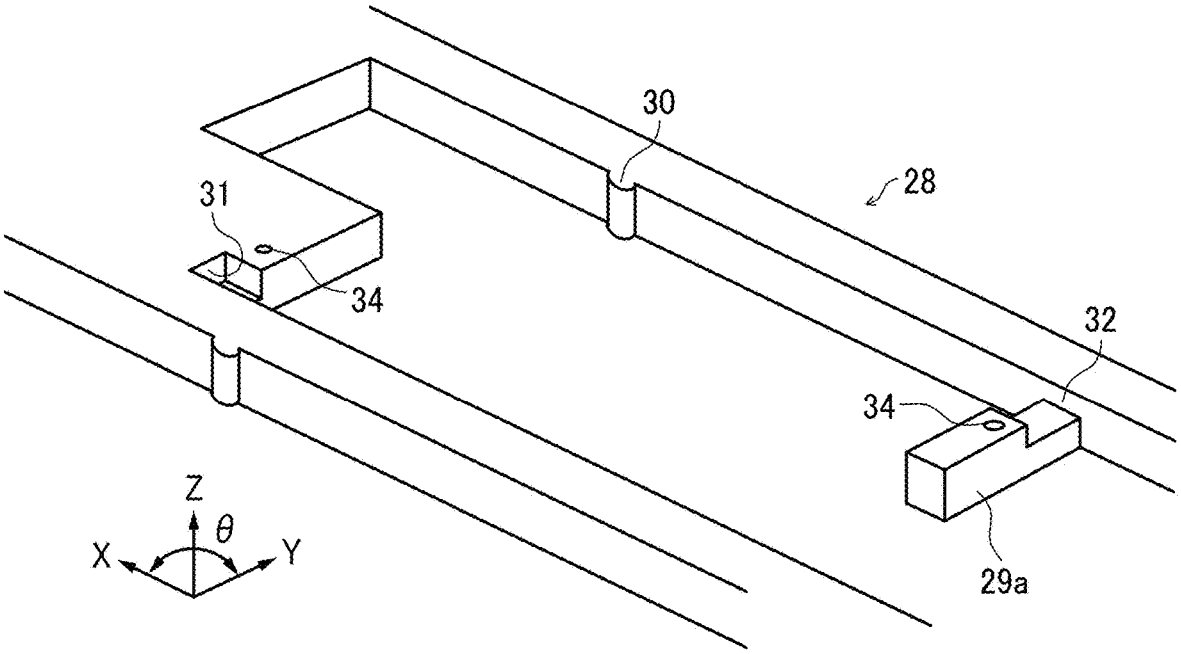
FIG. 5 is a schematic perspective view of an X-reference portion, a Y-reference portion, and θ-reference portion in the main plate in the embodiment of the present disclosure.

One Y-reference portion 30 is provided for each of the line-head modules 22 at corresponding portions of the arrangement portion 28*a* to which the first to fourth line-head modules 22 are fixed. Each convex portions integrally formed on the arrangement portion 28*a* of the main plate 28 constitutes the Y-reference portions 30 as also illustrated in FIGS. 4 and 5. The Y-reference portion 30 contacts the Y-reference surface of the line-head module 22 when the line-head module 22 is mounted to the arrangement portion 28*a*.

Then, the line-head module 22 is positioned in the Y-direction along a transverse direction of the recording head 2A perpendicular to a longitudinal direction of the recording head 2A (X-direction). That is, the line-head module 22 is positioned in the sheet conveyance direction (Y-direction).

Further, when the line-head module 22 is mounted to the arrangement portion 28*a* of the main plate 28, an upper surface of each of the fixing portions 29*a*, 29*b*, 29*c*, 29*d*, 29*e*, 29*f*, 29*g* and 29*h* contacts a bottom surface of a base plate 26 (see FIGS. 6A and 6B) of the line-head module 22 so that the line-head module 22 is positioned in the Z-direction that is a height direction of the line-head module 22. Specific configuration of the bottom surface of the base plate of the line-head module 22 is described below. Mounting positions of the line-head module 22 in the Y-direction and the Z-direction are determined by accuracy of parts when the line-head module 22 is mounted on the arrangement portion 28*a*.

Each of the fixing portions 29*g*, 29*b*, 29*d*, and 29*f* includes a X-reference portion 31 (see FIGS. 4 and 5). The X-reference portion 31 is used to position the line-head module 22 in the X-direction when the line-head module 22 is mounted to the arrangement portion 28*a* of the main plate 28. The X-direction is along a width direction of the recording sheet 8 and is also along the longitudinal direction of the recording head 2A. The line-head module 22 includes a first adjustment portion 35 (see FIG. 8) to adjust a position of the line-head module 22 relative to the main plate 28 in the X-direction. Only the X-reference portions 31 provided in the fixing portions 29*g* and 29*h* are illustrated in FIG. 4.

Each of the fixing portions 29*a*, 29*c*, 29*e*, and 29*h* further includes a θ-reference portion 32 (see FIGS. 4 and 5). The θ-reference portion 32 is used to position the line-head module 22 in the θ-direction when the line-head module 22 is mounted to the arrangement portion 28*a* of the main plate 28. The θ-direction is a rotational direction around the Y-reference portion 30 and is also a rotational direction of the line-head module 22. The line-head module 22 includes a second adjustment portion 36 (see FIG. 8) to adjust a position of the line-head module 22 relative to the main plate 28 in the θ-direction. Only the θ-reference portion 32 provided in the fixing portion 29*a* is illustrated in FIGS. 4 and 5.

Figure 6A:
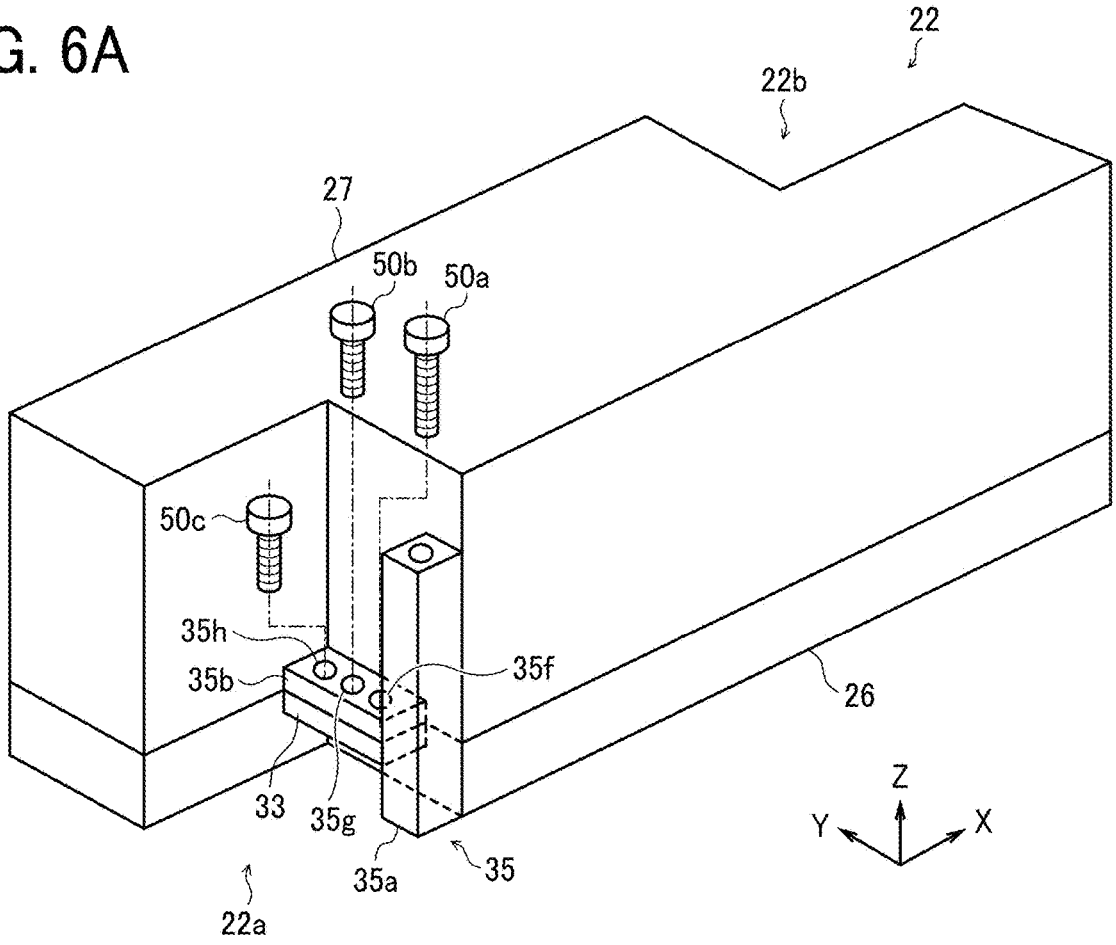
FIGS. 6A and 6B are schematic perspective views of a line-head module and a first adjustment portion in an embodiment of the present disclosure.
Figure 6B:
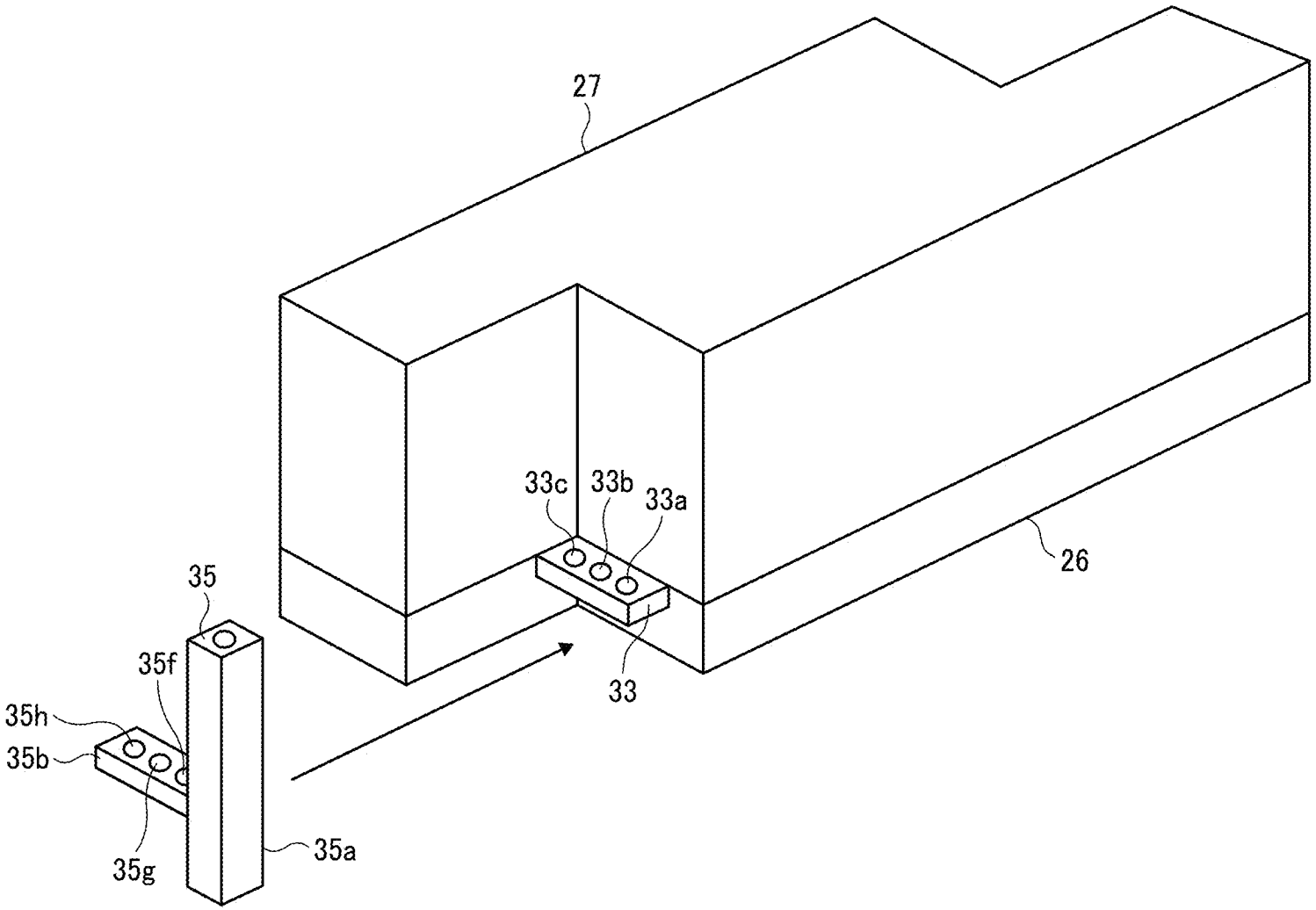

FIG. 6A is a perspective view of one line-head module 22. The line-head module 22 includes a liquid discharge head, an ink supply parts, and electrical components mounted on a base plate 26 as a substrate made of stainless steel. The line-head module 22 further includes a cover 27 to cover the liquid discharge head, the ink supply part, and the electrical components, for example. The liquid discharge head to discharge ink is specifically described below. The line-head module 22 has a Z-shaped plan view as illustrated in FIG. 2 and FIGS. 6A and 6B. As illustrated in FIG. 2, the line-head module 22 is configured to reduce a size of the recording head unit 2 when a plurality of line-head modules 22 are continuously arranged and arrayed on the main plate 28. As described above, the line-head module 22 includes two concave portions 22*a* and 22*b* that form the Z-shaped plan view of the line-head module 22.

Figure 7:
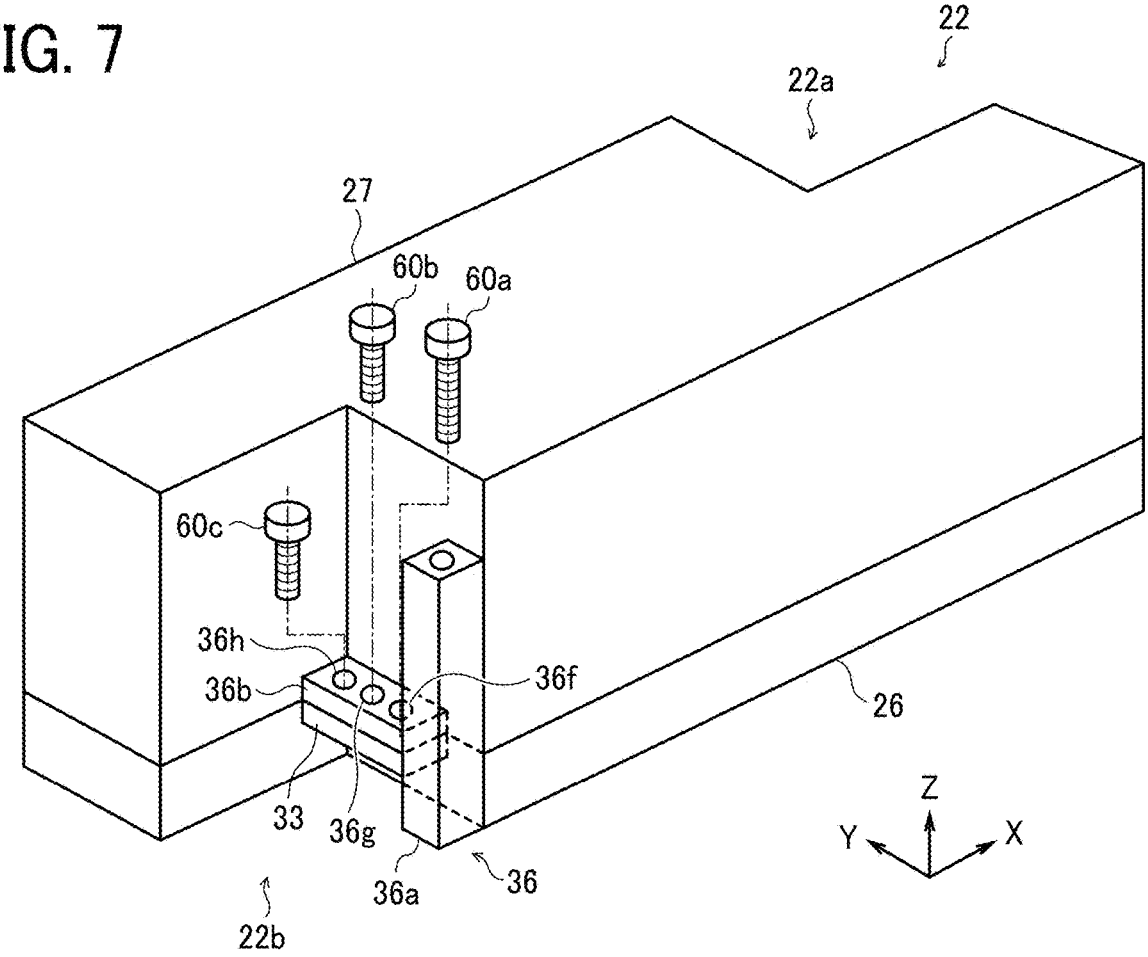
FIG. 7 is a schematic perspective view of a line-head module and a second adjustment portion in an embodiment of the present disclosure.

A fixed portion 33 to fix the base plate 26 to the main plate 28 is provided on the base plate 26. The fixed portion 33 is arranged on each of the concave portions 22A and 22B as illustrated in FIGS. 6 and 7. More specifically, the fixed portion 33 is provided on an inner side of an outermost periphery of the line-head module 22 in the X-direction (longitudinal direction of the line-head module 22) and on an inner side of the outermost periphery of the line-head module 22 in the Y-direction (transverse direction of the line-head module 22).

Figure 9A:
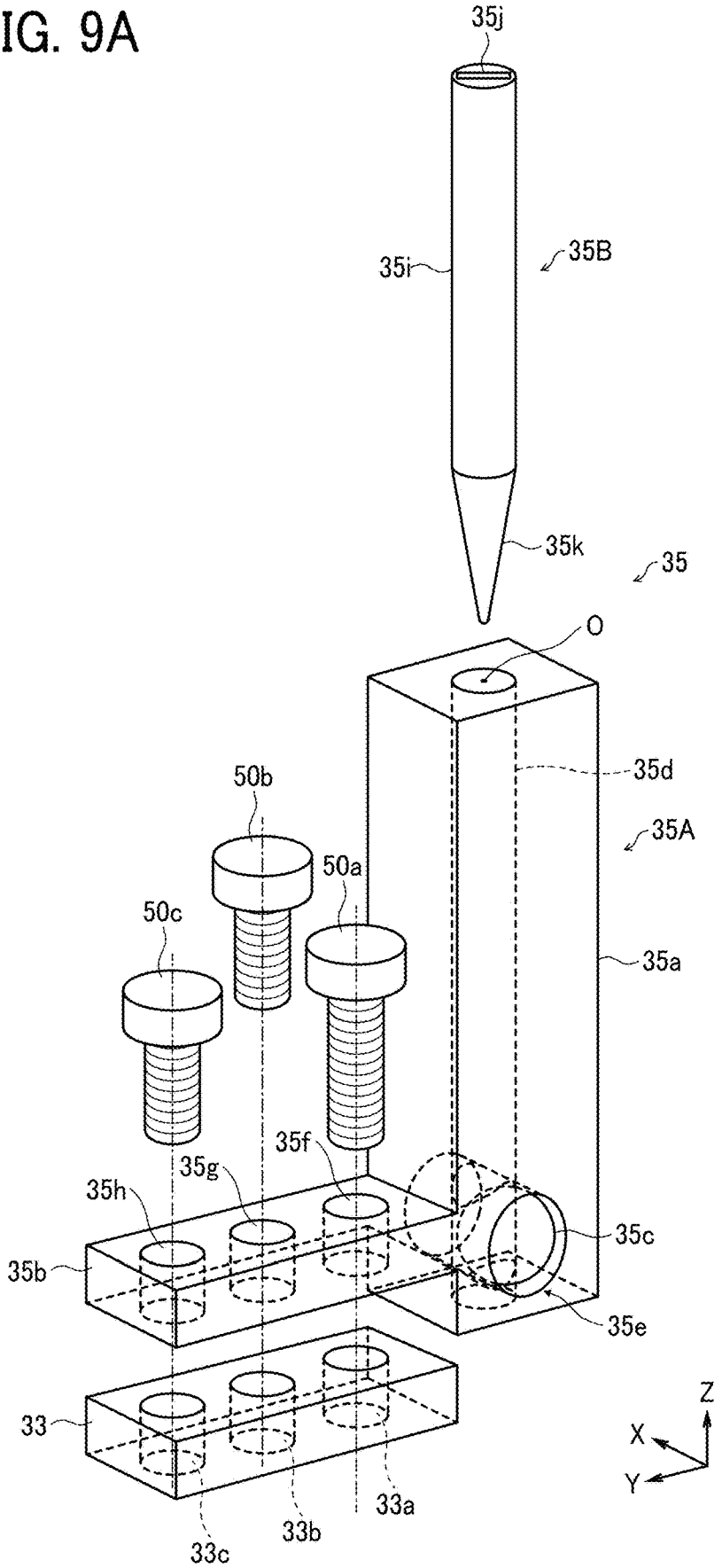
FIGS. 9A and 9B are schematic perspective views of the first adjustment portion in an embodiment of the present disclosure.

The fixed portion 33 includes screw holes 33*a* to 33*c* corresponding to three holes 35*f*, 35*g*, and 35*h*, respectively, of a first adjustment portion 35 as illustrated in FIG. 9A.

The screw holes 33*a* to 33*c* are simply referred to as "holes 33*a* to 33*c*".

As illustrated in FIG. 9A, a fixing screw 50*a* is inserted through the hole 35*f* of the first adjustment portion 35 and the hole 33*a* of the fixed portion 33 and screwed into a hole 34 formed in the fixing portion 29 of the main plate 28. Thus, the line-head module 22 is fixed to the main plate 28. FIG. 4 illustrates the holes 34 formed on the fixing portions 29*a*, 29*b* and 29*g*, respectively.

A configuration of the line-head module 22 is described below.

Figure 13:
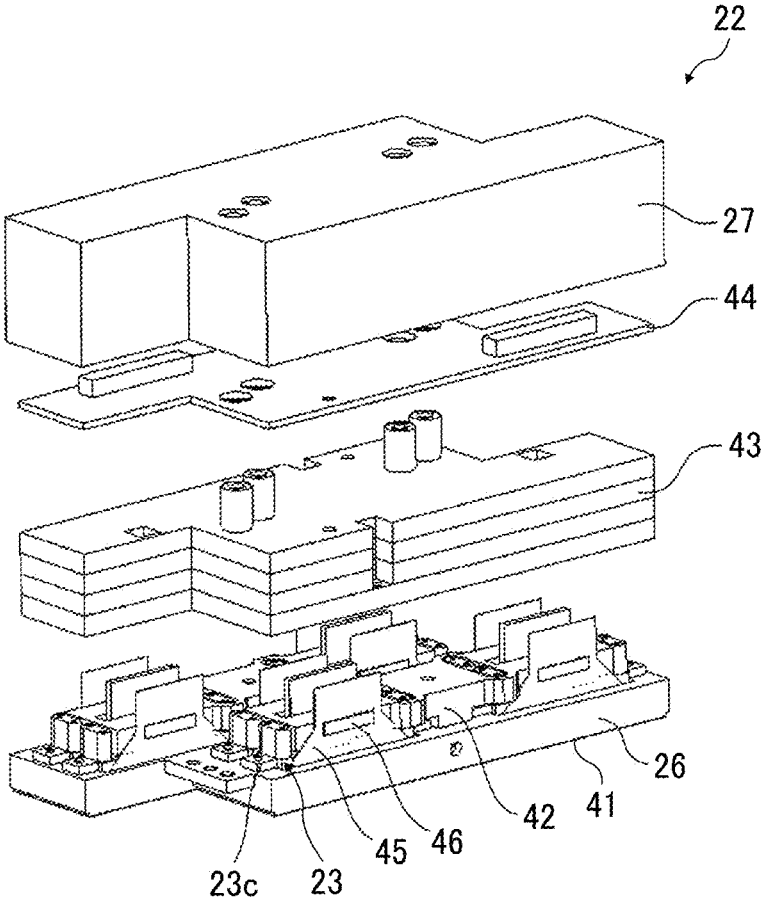
FIG. 13 is an exploded schematic perspective view of a line-head module in an embodiment of the present disclosure.
Figure 14:
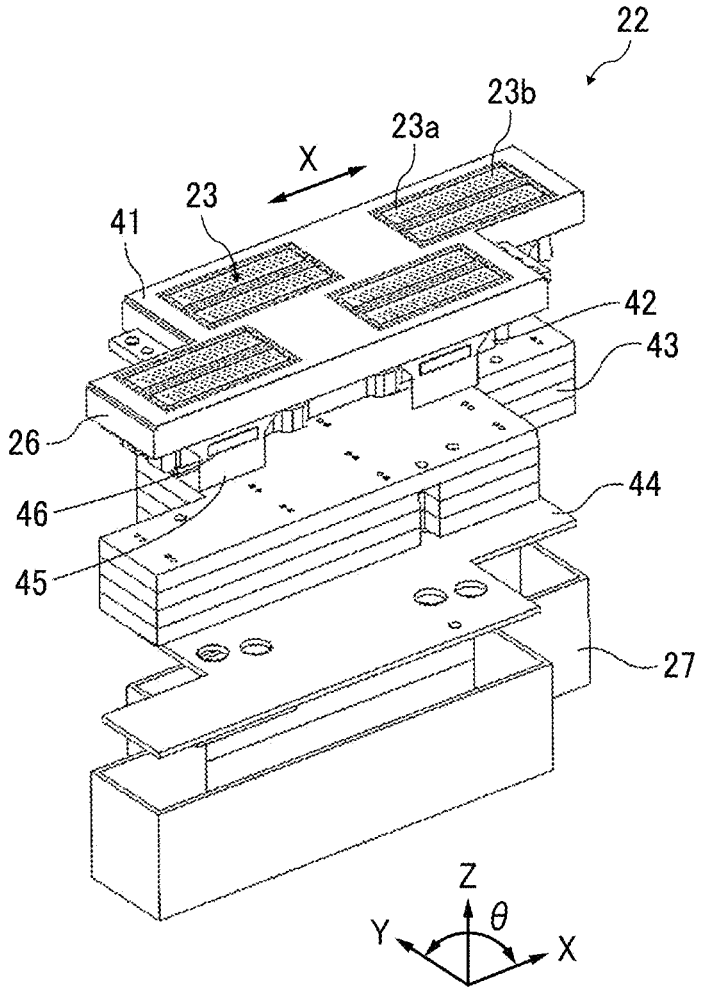
FIG. 14 is an exploded schematic perspective view of a line-head module in an embodiment of the present disclosure.

As illustrated in FIGS. 13 and 14, the line-head module 22 includes a plurality of heads 23 to discharge ink, a base plate 26, a base cover 41, a heat radiation member 42, a manifold 43, a printed circuit board 44, a cover 27 and the like.

Each of the plurality of heads 23 includes a nozzle plate 23*a*, nozzles 23*b* formed on the nozzle plate 23*a*, an individual channel plate including individual chambers communicating with the nozzles 23*b*, a diaphragm including a piezoelectric element, an intermediate channel plate laminated on a diaphragm, and a common channel plate laminated on the intermediate channel plate.

The printed circuit board 44 and a piezoelectric element in the head 23 are connected via a flexible wiring 45. A driver IC 46 as a drive circuit is mounted on the flexible wiring 45.

A plurality of heads 23 is arranged on the base plate 26 at a predetermined interval in the present disclosure. Specifically, as illustrated in FIG. 14, two heads 23 arranged in parallel in the Y-direction are one set. The line-head module 22 includes four sets of the heads 23 (total eight heads 23) arranged in a staggered manner in the X-direction (longitudinal direction of the head 23).

The head 23 is mounted to the base plate 26 by inserting the head 23 into an opening provided in the base plate 26 and bonding a peripheral portion of the nozzle plate 23*a* of the head 23 to the base cover 41. The base cover 41 is bonded and fixed to the base plate 26. Further, a flange 23*c* provided outside the common channel of the head 23 is joined and fixed to the base plate 26.

A fixing structure between the head 23 and the base plate 26 is not limited to the embodiments as described above, and a method such as adhesion, caulking, screw fastening, etc. can be adopted.

The base plate 26 is preferably formed of a material having a low linear expansion coefficient. For example, 42 alloy to which nickel is added to iron, invar material, etc. may be used as the material of the base plate 26. Thus, even if the head 23 generates heat and the temperature of the base plate 26 rises, the thermal expansion of the base plate 26 is small. Thus, the nozzles 23*b* do not easily sift from a predetermined position. Therefore, the line-head module 22 can reduce deviation of a landing position of the ink droplet discharged from the nozzles 23*b* onto the recording sheet 8.

The heat radiation member 42 is disposed to face the four heads 23 and the base plate 26. The heat radiation member 42 is preferably made of a metal material having a high thermal conductivity such as a metal containing aluminum, silver, copper, or gold.

The flexible wiring 45 on which the driver IC 46 is mounted is fixed to the heat radiation member 42 by a heat conduction tape. Thus, the driver IC 46 and the heat radiation member 42 are thermally coupled to each other via the flexible wiring 45 and the heat conduction tape. The term "thermally coupled" as used herein means that the heat generated from the driver IC 46 is in a state of being thermally conducted to the heat radiation member 42.

The cover 27 is attached to the base plate 26, and the cover 27 accommodates a part of the flexible wiring 45 including the printed circuit board 44, the manifold 43, the heat radiation member 42, and the driver IC 46 inside the cover 27.

The manifold 43 partially contacts the heat radiation member 42 by adhesion or packing. Thus, the line-head module 22 can reduce conduction of heat from the heat radiation member 42 to the manifold 43 that causes rising of temperature of ink in the line-head module 22. Thus, the line-head module 22 has reduced variation in discharge characteristics due to temperature rising.

Figure 8:
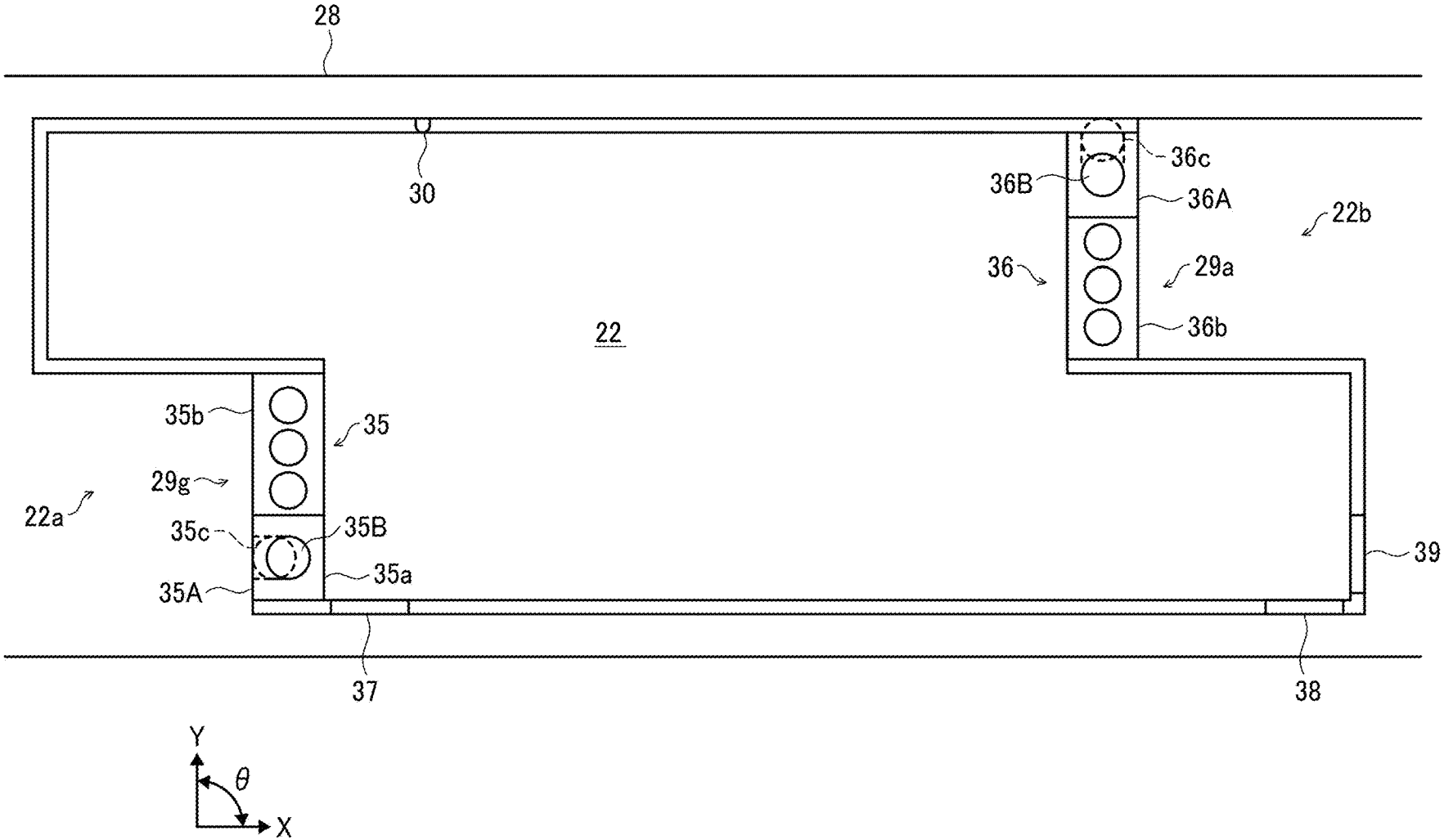
FIG. 8 is a schematic plan view of positioning and fixing of a line-head module to a main plate in an embodiment of the present disclosure.

The line-head module 22 includes the first adjustment portion 35 and a second adjustment portion 36 at positions corresponding to the two concave portions 22*a* and 22*b* on each of outer periphery of the cover 27 in the X-direction (see FIG. 8). The first adjustment portion (see FIG. 6) is used to adjust a position of the line-head module 22 in the X-direction (longitudinal direction of the line-head module 22). The second adjustment portion 36 (see FIG. 7) is used to adjust a position of the line-head module 22 in the θ-direction (rotational direction of the line-head module 22).

As illustrated in FIG. 8, the line-head module 22 includes a leaf spring 37 at vicinity of the fixing portion 29*g* and oppose to the Y-reference portion 30 via the line-head module 22. The leaf spring 37 urges the line-head module 22 toward the Y-reference portion 30 in the Y-direction (urges upward in the Y-direction in FIG. 8).

Further, the line-head module 22 includes a leaf spring 38 to urge the line-head module 22 upward in the Y-direction and a leaf spring 39 to urge the line-head module 22 leftward in the X-direction as illustrated in FIG. 8. The leaf springs 38 and 39 are disposed at vicinity of outer periphery of the line-head module 22 protruded in right direction at fixing portion 29*a* side.

Specifically, the leaf springs 38 and 39 are disposed at right lower end of the line-head module 22 in FIG. 8. The leaf spring 39 is disposed between adjacent line-head modules 22.

Figure 9B:
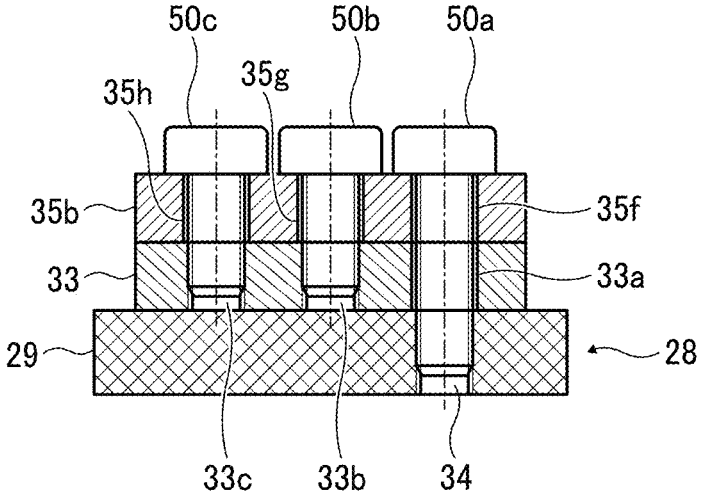

FIG. 9A is a perspective view of the first adjustment portion 35. FIG. 9B is a partial cross-sectional side view of the first adjustment portion 35. The first adjustment portion 35 includes a main body 35A and an adjustment screw 35B.

The main body 35A mainly includes a prismatic main portion 35*a*, an arm 35*b* formed together with the main portion 35*a*, and a ball 35*c* housed inside the main portion 35*a*.

The main body 35A includes a female screw 35*d* penetrating through a center of the main portion 35*a* in a height direction of the main portion 35*a* (in the Z-direction). Further, the main body 35A includes a hole 35*e* at a lower portion of the female screw 35*d* having a size that allows the ball 35*c* to fit inside the hole 35*e*. The hole 35*e* penetrates through the main portion 35*a* in the X-direction perpendicular to an extending direction of the female screw 35*d* (Z-direction). In the first adjustment portion 35, the hole 35*e* directs in the X-direction perpendicular to a direction of extension of the arm 35*b* (Y-direction). The ball 35*c* is a first moving member, and the hole 35*e* is a first hole.

Figure 10:
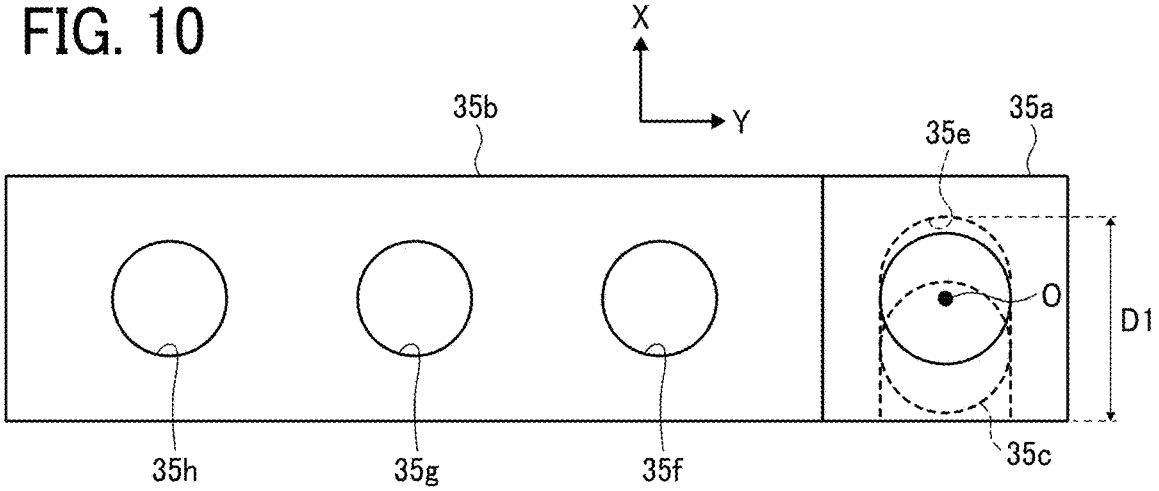
FIG. 10 is a schematic plan view of the first adjustment portion in an embodiment of the present disclosure.

In FIG. 9A, the hole 35*e* penetrates through the main portion 35*a* in the X-direction. However, the hole 35*e* does not have to penetrate through the main portion 35*a* in the X-direction, that is, does not have to penetrate through side surfaces in front and back direction of the main portion 35*a* in FIG. 9A. For example, the hole 35*e* may have a depth that allows a center of the ball 35*c* to be positioned near a center "O" of the female screw 35*d*, for example, have at least a depth "D1" as illustrated in FIG. 10.

The arm 35*b* is formed together with the main portion 35*a* as a single body and is extended outside from a lower side of the main portion 35*a*. The arm 35*b* includes three holes 35*f*, 35*g* and 35*h* respectively penetrating through the arm 35*b*. The hole 35*f* is formed at position corresponding to the hole 33*a* in the fixed portion 33. The holes 35*g* and 35*h* are formed at positions corresponding to the holes 33*b* and 33*c* in the fixed portion 33.

Thus, a fixing screw 50*a* inserted into the hole 35*f* of the arm 35*b* of the first adjustment portion 35 is inserted through the hole 33*a* of the fixed portion 33 and is screwed into the screw hole 34 formed in the fixing portion 29*g* of the main plate 28. Thus, the line-head module 22 and the first adjustment portion 35 are fixed to the main plate 28. Further, the fixing screws 50*b* and 50*c* inserted into the holes 35*g* and 35*h* are screwed into two holes 33*b* and 33*c* formed in the fixed portion 33, respectively. The first adjustment portion 35 is firmly fixed to the line-head module 22.

The adjustment screw 35B has a male screw 35*i* formed uniformly around an outer peripheral surface of the adjustment screw 35B. The male screw 35*i* can be screwed into the female screw 35*d*. A groove 35*j* is formed at an upper end of the adjustment screw 35B. A minus driver can be fitted into the groove 35*j*. The adjustment screw 35B is vertically movable along the female screw 35*d* (in Z-direction) in the main portion 35*a* while the adjustment screw 35B is rotated by the minus driver fitted in the groove 35*j*.

A tapered portion 35*k* is formed at a lower end of the adjustment screw 35B. When the tapered portion 35*k* contacts the ball 35*c* in the hole 35*e*, an outer circumferential surface of the ball 35*c* can be projected from an outer circumferential surface of the main portion 35*a* in which the hole 35*e* is formed.

Figure 9C:
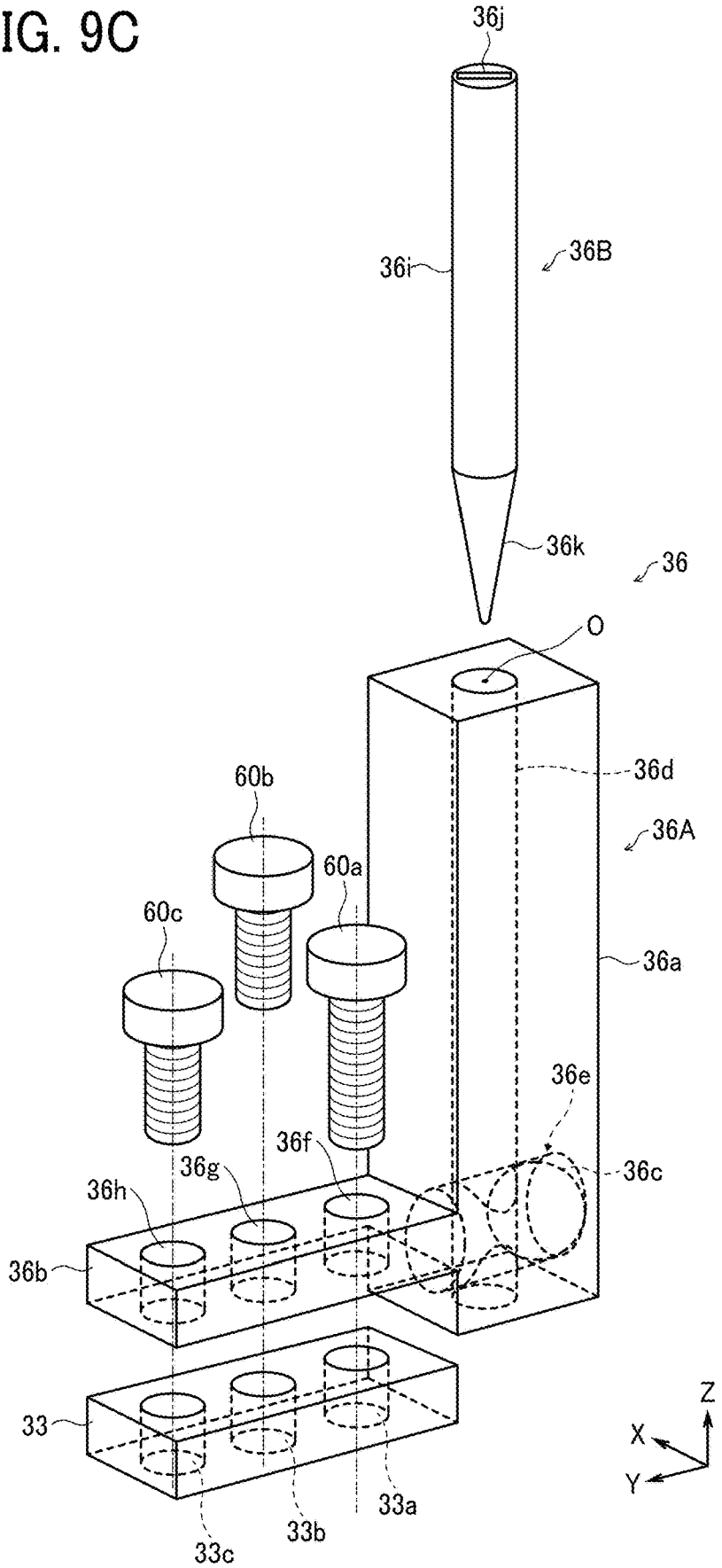
FIGS. 9C and 9D are schematic perspective views of the second adjustment portion in an embodiment of the present disclosure.
Figure 9D:
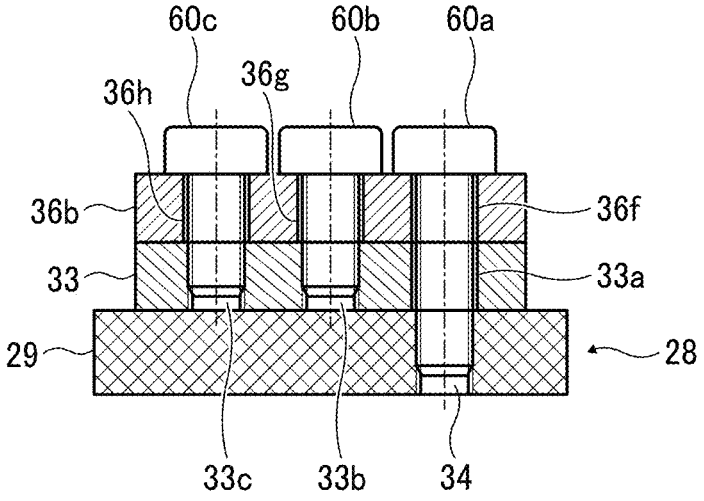

Next, the second adjustment portion 36 is described below. FIG. 9C is a perspective view of the second adjustment portion 36. FIG. 9D is a partial cross-sectional side view of the second adjustment portion 36.

As illustrated in FIG. 8, the second adjustment portion 36 also includes a main body 36A and an adjustment screw 36B, similarly to the first adjustment portion 35. The adjusting screw 36B has the same configuration as the adjustment screw 35B. The main body 36A is different from the main body 35A only in that a position of the hole 36*d* into which the ball 36*c* is inserted is different from the position of the hole 35*e* into which the ball 35*c* is inserted.

Thus, the adjustment screw 36B has a male screw 36*i* formed uniformly around an outer peripheral surface of the adjustment screw 36B. The male screw 36*i* can be screwed into the female screw 36*d*. A groove 36*j* is formed at an upper end of the adjustment screw 36B. A minus driver can be fitted into the groove 36*j*. The adjustment screw 36B is vertically movable along the female screw 36*d* (in Z-direction) in the main portion 36*a* while the adjustment screw 36B is rotated by the minus driver fitted in the groove 36*j*. A tapered portion 36*k* is formed at a lower end of the adjustment screw 36B. When the tapered portion 36*k* contacts the ball 36*c* in the hole 36*e*, an outer circumferential surface of the ball 36*c* can be projected from an outer circumferential surface of the main portion 36*a* in which the hole 36*e* is formed.

Figure 11:
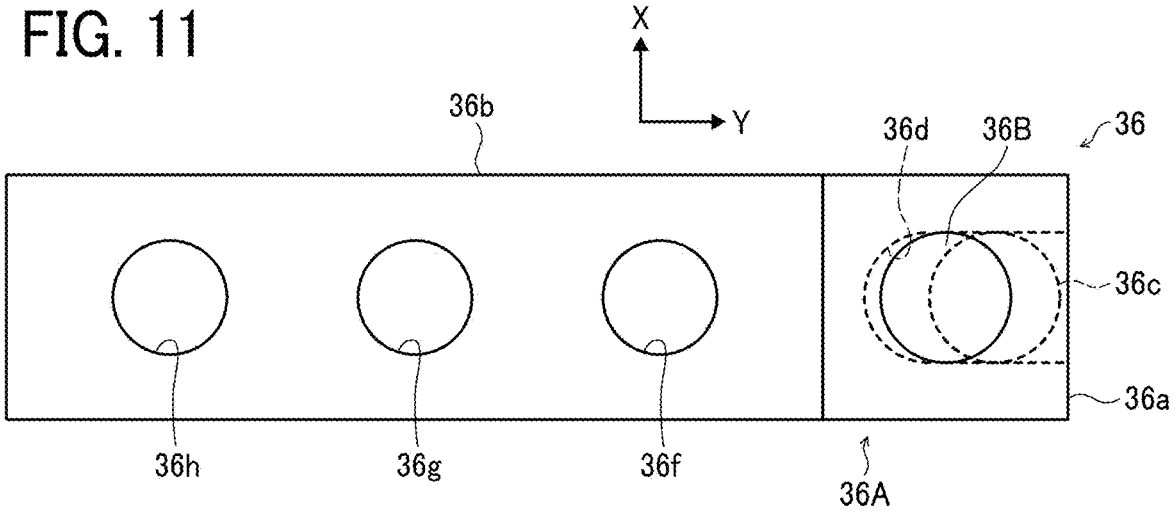
FIG. 11 is a schematic plan view of the second adjustment portion in an embodiment of the present disclosure.

As illustrated in FIG. 11, the main body 36A includes a main portion 36*a* configured similarly to the main portion 35*a* of the first adjustment portion 35 and an arm 36*b* configured similarly to the arm 35*b* of the first adjustment portion 35. A ball 36*c* configured similarly to the ball 35*c* of the first adjustment portion 35 is disposed at a lower part of the main portion 36*a*. The ball 36*c* is inserted into a hole 36*e* formed in a lower part of the main portion 36*a*. In the second adjustment portion 36, the hole 36*e* directs in the same direction with a direction of extension of the arm 36*b* (Y-direction). The ball 36*c* is a second moving member, and the hole 36*e* is a second hole.

Further, the arm 36*b* of the second adjustment portion 36 includes three holes 36*f*, 36*g*, and 36*h* formed in the same manner as the holes 35*f*, 35*g*, and 35*h* of the arm 35*b* of the first adjustment portion 35.

As illustrated in FIG. 8, the line-head module 22 is placed at a predetermined mounting position on the main plate 28. Then, the fixing screws 50*a* t0 50*c* and 60*a* to 60*c* are screwed into the holes 33*a* to 33*c* of the fixed portions 33. The fixing screw 50*a* and 60*a* are further screwed into the screw holes 34 formed in the fixing portion 29 of the main plate 28 to fix the line-head module 22 to the main plate 28 (see FIGS. 9B and 9D). Thus, the plurality of line-head modules 22 are fixed onto the main plate 28.

Thus, it is necessary to adjust positions of each of the line-head modules 22 to the main plate 28 in the X-direction and the θ-direction. Thus, the first adjustment portion 35 and the second adjustment portion 36 includes the adjustment screws 35B and 36B operated by an operator and the balls 35*c* and 36*c* as moving members moved by the operation of the adjustment screws 35B and 36B (see FIGS. 9A and 9B). A method of adjusting a position of the line-head module 22 is described below.

First, the fixing screws 50*a* t0 50*c* and 60*a* to 60*c* to the holes 30*a* to 30*c* of the fixing portions 29 to temporarily fix the line-head module 22 to the main plate 28. In a provisionally fixed state, the line-head module 22 is movable by a predetermined force acting on the line-head module 22. From the provisionally fixed state, the adjustment screw 35B of the first adjustment portion 35 is rotated and moved downward.

The outer peripheral surface of the ball 35*c* is pushed by the tapered portion 35*k* of the first adjustment portion 35 moved downward so that the ball 35*c* is projected from a side surface of the main portion 35*a* of the first adjustment portion 35.

As illustrated in FIG. 8, the line-head module 22 biased in the −X direction by a biasing force of the leaf spring 39 is moved in the +X direction according to an amount of protrusion of the ball 35*c* from the side surface of the main portion 35*a* so that a position of the line-head module 22 in the X-direction can be adjusted.

Similarly, the adjustment screw 36B of the second adjustment portion 36 is rotated to be moved downward from the provisionally fixed state. The outer peripheral surface of the ball 36*c* is pushed by the tapered portion 36*k* of the second adjustment portion 36 moved downward so that the ball 36*c* is projected from a side surface of the main portion 36*a* of the second adjustment portion 36.

As illustrated in FIG. 8, the line-head module 22 biased in a counterclockwise direction (−θ direction) by a biasing force of the leaf springs 37 and 38 is moved in the clockwise direction (+θ direction) according to an amount of protrusion of the ball 36*c* from the side surface of the main portion 36*a* so that a position of the line-head module 22 in the θ-direction can be adjusted.

As illustrated in FIGS. 9A and 9B, the fixing screws 50*a* and 60*a* are screwed to the holes 35*f* and 36*f* the first adjustment portion 35 and the second adjustment portion 36 and are screwed and fixed to the holes 34 of the main plate 28 so that the line-head module 22 is positioned and fixed to the main plate 28.

Thus, the above-described configuration can provide a recording head unit 2 including the first adjustment portion 35 and the second adjustment portion 36 having a simple configuration and a small number of parts without performing advanced processing on a body of the line-head module 22 and can provide an image forming apparatus including the above-described recording head unit 2. Thus, the present disclosure can provide a recording head unit and an image forming apparatus that can achieve all of printing with high speed and high-image quality and downsizing of machine.

Further, the line-head module 22 includes two fixed portions 33 and the first adjustment portion 35 and the second adjustment portion 36 for the two fixed portions 33, respectively. Thus, the present disclosure can reduce the size of the line-head module 22 that can be positioned and fixed to the main plate 28. The first adjustment portion 35 and the second adjustment portion 36 are arranged on the concave portions 22A and 22B, respectively as illustrated in FIG. 8.

Further, the first adjustment portion 35 and the second adjustment portion 36 are arranged symmetrically about a center of the line-head module 22 in a plan view of the line-head module 22 as illustrated in FIG. 8.

More specifically, the first adjustment portion 35 and the second adjustment portion 36 are arranged on an inner side of an outermost periphery of the line-head module 22 in the X-direction (longitudinal direction of the line-head module 22) and on an inner side of the outermost periphery of the line-head module 22 in the Y-direction (transverse direction of the line-head module 22). Thus, even when the recording head unit 2 includes a plurality of line-head modules 22, the present disclosure can prevent increase in size of the recording head unit 2 and reduce the size of the recording head unit 2.

Further, the recording head unit 2 includes the first adjustment portion 35 and the second adjustment portion 36 operated by the operator for position adjustment. Thus, the operator can easily adjust and fix the position of the line-head module 22 to the main plate 28 with a simple configuration.

Figure 12:
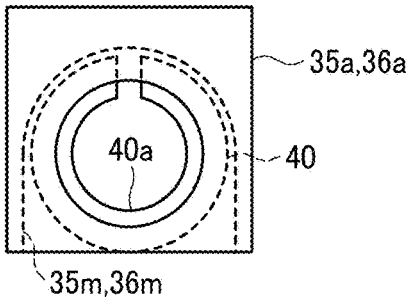
FIG. 12 is a schematic plan view of a moving member in a modified embodiment of the present disclosure.

FIG. 12 is a plan view of a C-shaped plate 40 that functions as a moving member used instead of the balls 35*c* and 36*c* in a modified embodiment of the present disclosure. The C-shaped plate 40 has a partially cutout C-shape. The C-shaped plate 40 is formed of a strong and elastic metal. The C-shaped plate 40 has a hole 40*a* at a center of the C-shaped plate 40. A diameter of the hole 40*a* is smaller than a diameter of the adjusting screws 35B and 36B. The C-shaped plate 40 is disposed on each of a lower part of the main portions 35*a* and 36*a* at positions where the holes 35*e* and 36*d* are formed.

The C-shaped plate 40 is inserted in each of grooves 35*m* and 36*m* formed in the main portions 35*a* and 36*a*, respectively. The grooves 35*m* and 36*m* have a size to which the C-shaped plate 40 does not contact when the tapered portion 35*k* of the adjustment screws 35B and 36B are inserted into the hole 40*a* of the C-shaped plate 40 to expand the hole 40*a* of the C-shaped plate 40. In FIG. 12, the C-shaped plates 40 are a first moving member and a second moving member, and the grooves 35*m* and 36*m* are a first groove and a second groove, respectively.

Thus, the hole 40*a* of the C-shaped plate 40 expands as the tapered portion 35*k* moves downward with operation (rotation) of the adjusting screws 35B and 36B for the position adjustment, thereby causing an outer peripheral surface of the C-shaped plate 40 to protrude from the side surface of the main portion 35*a*, and the position of the line-head module 22 is adjusted as in the embodiment using the balls 35*c* and 36*c* as illustrated in FIGS. 10 and 11.

The configuration using the C-shaped plate 40 can function similarly to and achieve the same effects as the embodiments using the balls 35*c* and 36*c* described above. The C-shaped plate 40 is easy to form compared to the balls 35*c* and 36*c* in the above embodiment, and the C-shaped plate 40 thus can reduce the manufacturing cost of the first adjustment portion 35 and the second adjustment portion 36.

Although a color printer is used as an example of an image forming apparatus in the present embodiment and the modified example, the image forming apparatus is not limited to a color printer. The image forming apparatus according to the present disclosure may be a printer, a facsimile machine, and multifunction peripherals, and the like.

Similarly, the recording sheet 8 is used as a recording medium on which an image is formed in the present disclosure and the modified example. However, the recording medium is not limited to the recording sheet 8 and may also include thick paper, a postcard, an envelope, a plain paper, thin paper, a coated paper (coated paper or art paper), a tracing paper, an overhead projector (OHP) sheet, an overhead projector (OHP) film, a resin film, and the like. Any material may be used for the recording medium as long as the material is sheet-like and one on which an image can be formed.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. Although most preferable advantages are described above, advantages of the present disclosure are not limited to the advantages described above.

What is claimed is:

1. A recording head unit, comprising:

a line-head module including a plurality of recording heads to discharge a liquid; and a main plate to which the line-head module is mounted, wherein the line-head module includes:

a first adjustment portion to adjust a position of the line-head module relative to the main plate in a longitudinal direction of the line-head module; and a second adjustment portion to adjust a position of the line-head module relative to the main plate in a rotational direction of the line-head module, wherein each of the first adjustment portion and the second adjustment portion is provided on an inner side of an outermost periphery of the line-head module in a longitudinal direction of the line-head module and on an inner side of an outermost periphery of the line-head module in a transverse direction of the line-head module, wherein the first adjustment portion includes a first moving member movable in the longitudinal direction to protrude from the outermost periphery of the line-head module in the longitudinal direction of the line-head module and the second adjustment portion includes a second moving member movable in the transverse direction to protrude from the outermost periphery of the line-head module in the transverse direction, wherein the first adjustment portion further includes a first screw having a tapered end to contact and move the first moving member; and the second adjustment portion further includes a second screw having a tapered end to contact and move the second moving member, wherein each of the first moving member and the second moving member is a ball, the first adjustment portion including a first hole extending in the longitudinal direction to movably accommodate the first moving member, and the second adjustment portion including a second hole extending in the transverse direction to movably accommodate the second moving member.

2. The recording head unit of claim 1, wherein the line-head module includes at least two fixed portions to fix the line-head module to the main plate, wherein one of the at least two fixed portions is fixed to the first adjustment portion, and another one of the at least two fixed portions is fixed to the second adjustment portion.

3. The recording head unit of claim 1, wherein the first adjustment portion and the second adjustment portion are arranged symmetrically about a center of the line-head module in a plan view of the line-head module.

4. An image forming apparatus comprising the recording head unit of claim 1.

5. A recording head unit, comprising:

a line-head module including a plurality of recording heads to discharge a liquid; and a main plate to which the line-head module is mounted, wherein the line-head module includes:

a first adjustment portion to adjust a position of the line-head module relative to the main plate in a longitudinal direction of the line-head module; and a second adjustment portion to adjust a position of the line-head module relative to the main plate in a rotational direction of the line-head module, wherein each of the first adjustment portion and the second adjustment portion is provided on an inner side of an outermost periphery of the line-head module in a longitudinal direction of the line-head module and on an inner side of an outermost periphery of the line-head module in a transverse direction of the line-head module, wherein the first adjustment portion includes a first moving member movable in the longitudinal direction to protrude from the outermost periphery of the line-head module in the longitudinal direction of the line-head module and the second adjustment portion includes a second moving member movable in the transverse direction to protrude from the outermost periphery of the line-head module in the transverse direction, wherein the first adjustment portion further includes a first screw having a tapered end to contact and move the first moving member; and the second adjustment portion further includes a second screw having a tapered end to contact and move the second moving member, wherein each of the first moving member and the second moving member is a C-shaped plate including an expandable hole, the first adjustment portion including a first groove extending in the longitudinal direction to movably accommodate the first moving member, and the second adjustment portion including a second groove extending in the transverse direction to movably accommodate the second moving member.

6. The recording head unit of claim 5, wherein the line-head module includes at least two fixed portions to fix the line-head module to the main plate, wherein one of the at least two fixed portions is fixed to the first adjustment portion, and another one of the at least two fixed portions is fixed to the second adjustment portion.

7. The recording head unit according to claim 5, wherein the first adjustment portion and the second adjustment portion are arranged symmetrically about a center of the line-head module in a plan view of the line-head module.

8. An image forming apparatus comprising the recording head unit of claim 5.

9. A line-head module comprising:

a plurality of recording heads to discharge a liquid;

a first adjustment portion to adjust a position of the line-head module in a longitudinal direction of the line-head module; and a second adjustment portion to adjust a position of the line-head module in a rotational direction of the line-head module, wherein each of the first adjustment portion and the second adjustment portion is provided on an inner side of an outermost periphery of the line-head module in a longitudinal direction of the line-head module and on an inner side of an outermost periphery of the line-head module in a transverse direction of the line-head module, wherein the first adjustment portion includes a first moving member movable in the longitudinal direction to protrude from the outermost periphery of the line-head module in the longitudinal direction of the line-head module; and the second adjustment portion includes a second moving member movable in the transverse direction to protrude from the outermost periphery of the line-head module in the transverse direction, wherein the first adjustment portion further includes a first screw having a tapered end to contact and move the first moving member and the second adjustment portion further includes a second screw having a tapered end to contact and move the second moving member, wherein each of the first moving member and the second moving member is a ball, the first adjustment portion including a first hole extending in the longitudinal direction to movably accommodate the first moving member, and the second adjustment portion including a second hole extending in the transverse direction to movably accommodate the second moving member.

10. The line-head module of claim 9, wherein the line-head module includes at least two fixed portions to fix the line-head module to the main plate, wherein one of the at least two fixed portions is fixed to the first adjustment portion, and another one of the at least two fixed portions is fixed to the second adjustment portion.

11. The line-head module of claim 9, wherein the first adjustment portion and the second adjustment portion are arranged symmetrically about a center of the line-head module in a plan view of the line-head module.

* * * * *